United States Patent [19]

Nosrati

[11] Patent Number: 4,704,934

[45] Date of Patent: Nov. 10, 1987

[54] MUSICAL BALLOON

[76] Inventor: Mohammad Nosrati, 331 Phillip Dr., #307, Daly City, Calif. 94015

[21] Appl. No.: 5,479

[22] Filed: Jan. 20, 1987

[51] Int. Cl.[4] ..... G10F 1/06

[52] U.S. Cl. ..... 84/94.2; 446/220

[58] Field of Search ..... 84/94 C, 95 C; 40/906; 446/220, 221, 222, 397

[56] References Cited

U.S. PATENT DOCUMENTS

| | | | |
|---|---|---|---|
| 1,283,095 | 10/1918 | Cummiskey | 446/220 |
| 2,383,390 | 8/1945 | Jacobs | 446/220 X |
| 4,652,980 | 3/1987 | Segan | 84/94 C |

FOREIGN PATENT DOCUMENTS

| | | | |
|---|---|---|---|
| 893680 | 4/1962 | United Kingdom | 446/221 |

*Primary Examiner*—L. T. Hix

*Assistant Examiner*—Brian W. Brown

[57] ABSTRACT

A musical balloon has an electronic music-producing device contained within an inner, nearly opaque balloon. An outer balloon of any desired color and design, more light transmissive than the inner balloon, covers the inner balloon. The electronic music-producing device includes an on/off switch sensitive to light. When the balloons are deflated, the rubber material is dense enough to keep light from activating the music. However, when the balloons are inflated, the rubber material is stretched to a more translucent condition, and sufficient light permeates the balloons to activate the switch and the music.

5 Claims, 3 Drawing Figures

MUSICAL BALLOON

BACKGROUND OF THE INVENTION

The invention relates to novelties or amusement devices in general, and more particularly to an inflatable balloon, as for a party favor or decoration, containing an electronic music-producing device inside the balloon for playing a tune which may be appropriate for a particular occasion.

Electronic music-producing devices are well known. They have been included in greeting cards, such as birthday cards wherein a "Happy Birthday" melody is played when the card is opened.

For this purpose, such electronic music-producing devices have often been coupled to a mechanical switch connected to the card, so that the melody does not play until the greeting card is opened by the recipient.

SUMMARY OF THE INVENTION

In accordance with the present invention, an electronic music-producing device, along with a battery and a light-sensitive photodetector switch, is contained within a balloon which is nearly opaque in the deflated condition. Light penetrating the balloon is not sufficient to activate the photodetector switch to turn on the music, until the balloon is inflated to such a degree that the rubber material is stretched to be sufficiently translucent to activate the switch. The degree to which the balloon must be inflated depends on the brightness of light existing outside the balloon.

In a preferred embodiment of the invention, there are included an inner balloon and an outer balloon. The inner balloon is nearly opaque in the deflated condition, and may be black or another very dark color. The music-producing device, battery and switch are contained within the dark inner balloon.

An outer balloon surrounds the inner balloon, and may be of any desired color and translucency, bearing any desired greeting, slogan or message on its exterior.

Although the outer balloon contributes to some extent to the opacity of the light barrier which must be penetrated to activate the switch, it is preferred that the inner balloon be of a substantially higher opacity than the outer balloon, so that the on/off function is controlled primarily by the opacity of the inner balloon.

When the balloon of the invention is inflated the two balloons are blown up together. As they are inflated to a point wherein the balloon material is stretched to be sufficiently translucent, ambient light penetrates the two balloons, strikes the photodetector switch and activates the music-producing device.

The balloon may then be tied off to retain its inflation, if desired.

In another embodiment of the invention, only one balloon is used. It is of sufficient thickness and opacity that it can be of substantially any desired color and still function according to the principles of the invention. The photodetector switch coupled to the music-producing device can be "tuned" (or selected) to be switched on at different light levels, and, if a single balloon is used, the switch can be tuned or selected to require a relatively high level of light for activation. In this way, the opacity of the single balloon can in effect be less than the combined opacity of the two balloons together in the first embodiment of the invention, while still effecting similar operation.

It is therefore among the objects of the present invention to provide an amusement or novelty device in the form of a balloon which requires inflation to a certain extent to activate a music-producing device contained inside. This and other objects, advantages, features and characteristics of the invention will be apparent from the following description of a preferred embodiment, considered along with the accompanying drawings.

DESCRIPTION OF PREFERRED EMBODIMENT

Figure 1:
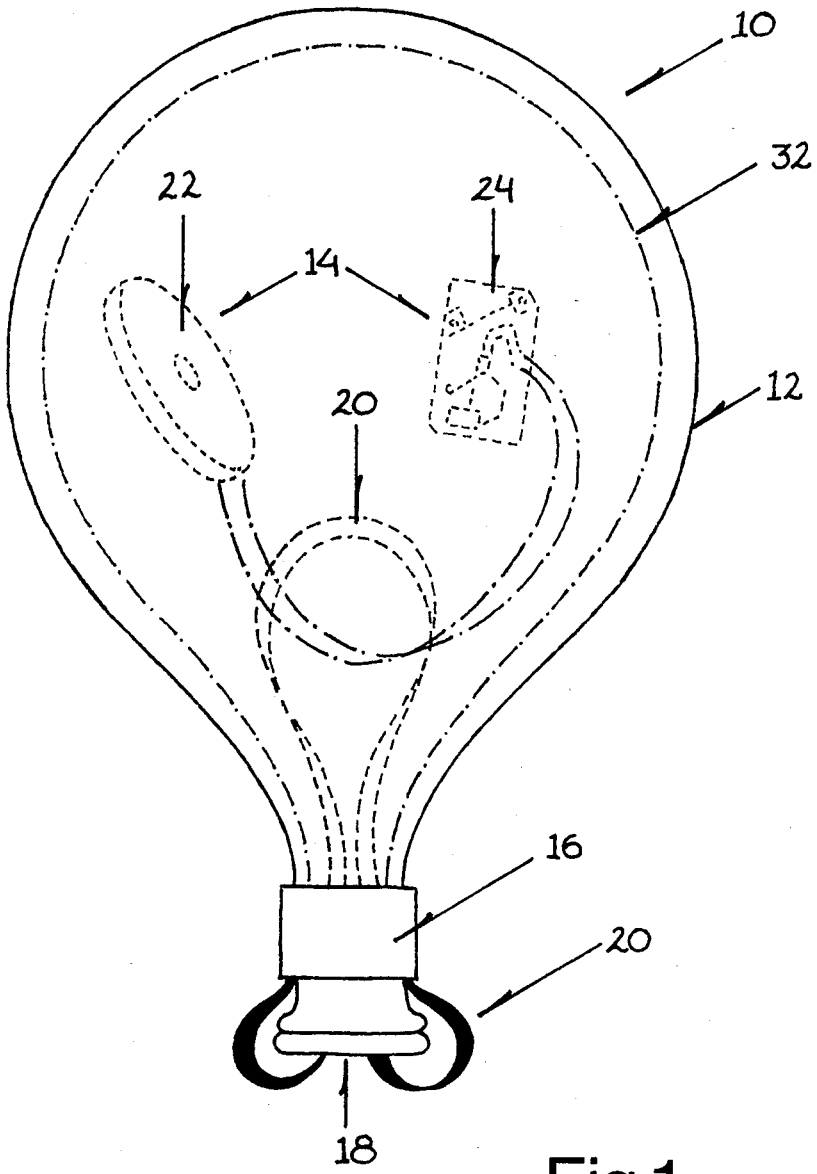
FIG. 1 is an elevation view showing a musical balloon in accordance with the invention, with components inside the balloon shown in dashed lines.

In the drawings, FIG. 1 shows a musical balloon generally identified by the reference number 10, including an inflatable balloon 12 of a rubber or rubber-like stretchable material, a light-controlled melody module indentified generally as 14, show in dashed lines inside the balloon 12, a retention band 16 on the outside of the balloon neck, near the mouthpiece 18, and a retention ribbon 20, secured to the retention band 16 and extending inside the balloon 12 as illustrated, to retain the melody module 14 in a desired position within the balloon.

Figure 2:
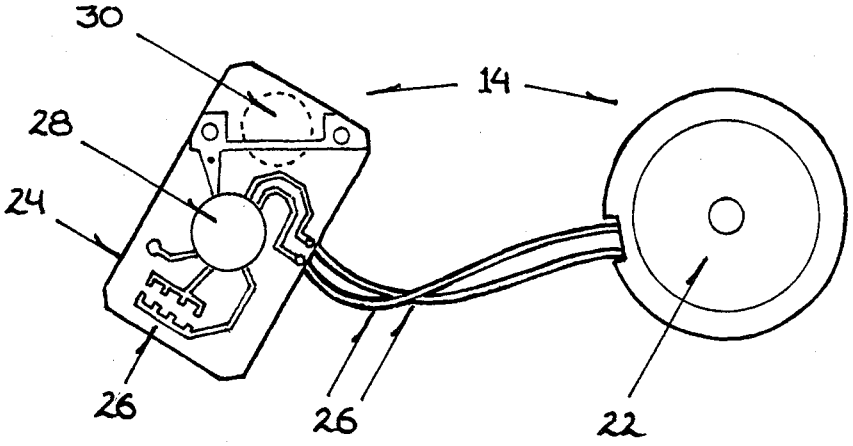
FIG. 2 is a view showing an electronic music-producing device which may be used in the musical balloon of the invention, including a light-sensitive photodetector switch.

As shown in FIG. 1 and in greater detail in FIG. 2, the light-controlled melody module 14 includes a speaker 22 capable of producing modulated, stepped tones, programmed electronic modulator circuitry represented generally on the board 24 illustrated, wires 26 leading from the board 24 to the speaker 22, and a photodetector switch indicated at 26, for activating the music circuit only when a preselected level of light exists at the photodetector switch 26.

An integrated circuit in the form of a small chip 28 is included on the board 24, programmed to modulate tones produced by the speaker 22 in accordance with a preselected melody to be played. A battery 30, shown in dashed lines, is mounted on the opposite side of the melody module board 24.

The light-controlled melody module 14 may be any of several types that are commonly available. The music generation components 28, 22 may be of the type commonly found in musical greeting cards. As an example, the light-sensitive module 14 can be of the type produced by Lokslin Co., Ltd. of 499 Castle Peak Road, Kowloon, Hong Kong. Such a module may include the following components: speaker 22 —27 mm speaker made by Wahyen Co. of China; photodetector switch 26 —phototransistor sold by Opeto Co. of Taiwan; integrated circuit melody modulator chip 28 —CMOS No. 1205 produced by NCP of Japan.

The inflatable balloon 12 shown in FIG. 1, as discussed above, can be a single balloon with sufficient opacity when deflated to attenuate light passing through to the extent that the module 24 will not activate the music. Alternatively, two balloons can be utilized, one inside the other. Thus, an inner balloon 32 (shown in dashed lines in FIG. 1) can be almost totally opaque in the deflated condition, and of a dark color such as black. The outer balloon 12 can then be of any decorative color and translucency, with the inner balloon 32 relied upon almost exclusively for attenuation of light.

When the double balloon assembly is inflated, the inner, higher-opacity balloon 32 is stretched and thinned to the extent that sufficient light passes through the two balloons to activate the module 14 and produce the music.

Figure 3:
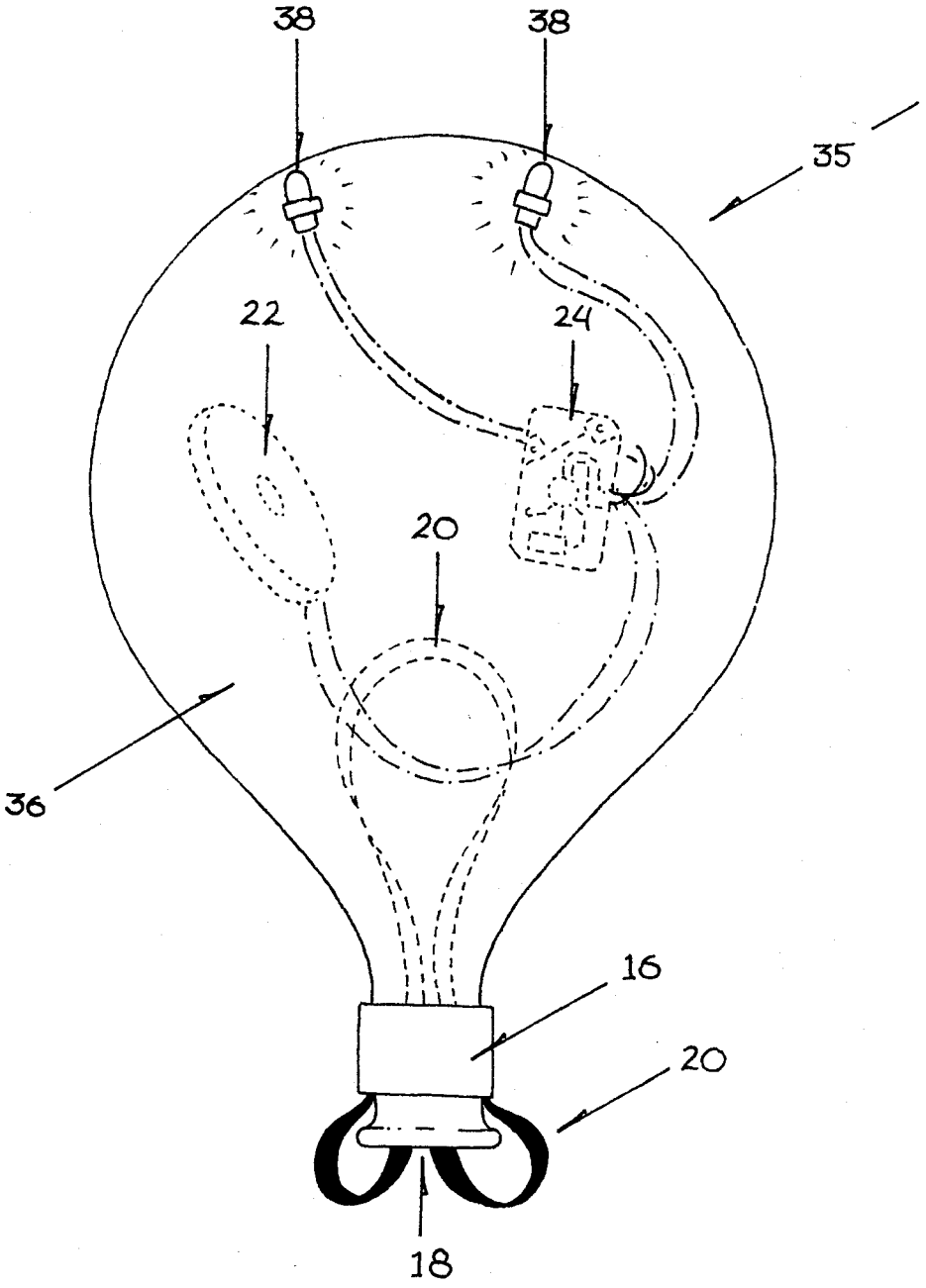
FIG. 3 is a sectional elevation view of a musical balloon in accordance with another embodiment of the invention, wherein the electronic components inside the balloon also include light sources.

FIG. 3 shows another embodiment of the invention in cross-sectional view. A musical and illuminated balloon 35, which may be a single or a double balloon, as above, is constructed generally similarly to the embodiment 10 illustrated in FIG. 1. It includes a retention band 16 and retention ribbon 20, but inside is an LED light-controlled melody module 36, having one or more light-emitting diodes 38 connected in a circuit with the music generating chip and speaker 22. When light at a sufficient intensity penetrates the balloon, a photodetector switch is activated to cause the chip (not specifically shown) to produce the desired melody through the speaker 22, and at the same time the LEDs 38 are activated to produce light which penetrates outwardly through the balloon.

Again, the LED light-controlled melody module 36 may be of the type supplied by Lokslin Co., Ltd. of Kowloon, Hong Kong. It may include the components listed above as well as one or more LEDs 38, connected in parallel with the music circuit.

The above-described preferred embodiment is intended to illustrate the principles of the invention, but not to limit its scope. Other embodiments and variations to this preferred embodiment will be apparent to those skilled in the art and may be made without departing from the scope of the invention as defined in the claims.

I claim:

1. A musical balloon, comprising, an inflatable balloon of stretchable, rubbery wall material having a preselected degree of opacity when deflated and capable of stretching and thinning in its wall as it is inflated, producing lesser and lesser degrees of opacity in the balloon wall, an electronic musical melody module contained within the balloon, including a speaker, an integrated circuit tone modulator and a battery, and light sensitive switch means connected to the melody module for activating the melody module only when a preselected level of light permeates the balloon wall and strikes the switch means, whereby the melody module is switched off and silent when the balloon is deflated, but is activated by the light-sensitive switch means when the balloon is inflated to the extent that the balloon wall is stretched and thinned enough to let outside light penetrate the balloon wall to said predetermined level.

2. The musical balloon of claim 1, further including at least one light-emitting diode connected to the melody module, for producing light inside the balloon, visible from outside the balloon, whenever the melody module is activated.

3. The musical balloon of claim 1, wherein said inflatable balloon includes an inner, higher-opacity balloon and an outer-decorative, lower-opacity balloon.

4. The musical balloon of claim 1, wherein the balloon has a neck and mouthpiece, and further including a retention ribbon extending into the balloon's interior through the neck and connected to the musical melody module, and retaining means for connecting the ribbon to the balloon to generally hold the musical melody module at a desired location in the balloon.

5. The musical balloon of claim 4, wherein the retaining means comprises a retention band secured around the balloon's neck adjacent to the mouthpiece, with the retention ribbon extending out of the mouthpiece and connected to the retention band.

* * * * *